US008939238B2

(12) United States Patent
Martensson et al.

(10) Patent No.: US 8,939,238 B2
(45) Date of Patent: Jan. 27, 2015

(54) HIGH QUALITY PCD COMPACT

(75) Inventors: Malin Martensson, Nacka (SE); Yuanbo Lin, Lewis Center, OH (US); Andreas Markstrom, Stockholm (SE); Susanne Norgren, Huddinge (SE)

(73) Assignee: Diamond Innovations, Inc., Worthington, OH (US)

( * ) Notice: Subject to any disclaimer, the term of this patent is extended or adjusted under 35 U.S.C. 154(b) by 593 days.

(21) Appl. No.: 13/226,361

(22) Filed: Sep. 6, 2011

(65) Prior Publication Data

US 2012/0055716 A1 Mar. 8, 2012

Related U.S. Application Data

(60) Provisional application No. 61/379,900, filed on Sep. 3, 2010.

(51) Int. Cl.

| | |
|---|---|
| ***E21B 10/36*** | (2006.01) |
| ***C22C 26/00*** | (2006.01) |
| *B22F 5/00* | (2006.01) |

(52) U.S. Cl.

CPC ..... *C22C 26/00* (2013.01); *B22F 2005/001* (2013.01)

USPC ..... 175/433; 175/420.2; 175/428; 175/434

(58) Field of Classification Search

CPC .. E21B 10/567; E21B 10/46; B22F 2302/406

USPC ..... 175/420.2, 426, 428, 433, 434

See application file for complete search history.

(56) References Cited

U.S. PATENT DOCUMENTS

| | | | |
|---|---|---|---|
| 2005/0061105 | A1 | 3/2005 | Bennett |
| 2008/0115421 | A1 | 5/2008 | Sani |

FOREIGN PATENT DOCUMENTS

| | | | |
|---|---|---|---|
| WO | 2008053430 | A1 | 5/2008 |
| ZA | WO2008053430 | A1 | 5/2008 |

*Primary Examiner* — Cathleen Hutchins

(57) ABSTRACT

A sintered cutting element including a superabrasive layer supported on a substrate. The superabrasive layer includes superabrasive material and secondary phase, and the substrate includes a binder phase. The sintered cutting element is formed by a high temperature high pressure sintering process in which separate source elements melt and sweep first through the superabrasive layer, and then to the substrate to form the secondary phase and binder phase. The superabrasive layer is substantially free of or free of eta-phase, $Co_3W_3C$. Further, the portion of the substrate nearest the interface between the superabrasive layer and the substrate has equal or more binder phase than portions of the substrate further from the interface. In certain embodiments, the superabrasive material includes polycrystalline diamond, and the substrate includes cobalt tungsten carbide.

24 Claims, 5 Drawing Sheets

HIGH QUALITY PCD COMPACT

CROSS-REFERENCE TO RELATED APPLICATIONS

This application is based upon and claims priority of U.S. Provisional Patent Application No. 61/379,900, filed on Sep. 3, 2010.

TECHNICAL FIELD AND INDUSTRIAL APPLICABILITY

The present disclosure relates to superabrasive compact cutting elements, for example, cutters utilized in drag bits. More specifically, the cutting elements include a layer of bonded superabrasive materials, also referred to as a table that is supported by or joined coherently to a substrate or post or stud. The disclosure also relates to a production method of such cutting elements.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Currently available cutting elements utilized in drag bits use superabrasive materials such as, but not limited to, polycrystalline diamond (PCD). The superabrasive layer or table is supported by or joined coherently to a substrate, post or stud that is generally made of cobalt tungsten carbide or cemented carbide. Cobalt tungsten carbide is generally selected for the substrate because of its excellent mechanical properties like abrasion resistance and compressive strength.

Bonding the superabrasive layer to the substrate generally occurs during the sintering stage of the superabrasive layer at high-pressure high-temperature (HPHT). Particularly when the superabrasive layer is PCD, the sintered PCD layer is composed of diamond particles with extensive amounts of direct diamond-to-diamond bonding or contact as the major phase. In the interstices between the diamond particles, and to some extent between some of the bonded diamond particles at their boundaries, there is a secondary phase which is also called the metal phase or the catalyst solvent phase. This secondary phase forms a network intermingled with the diamond network. The secondary phase serves as the catalyst or solution for the growth of the diamond-to-diamond bonding. The secondary phase generally includes at least one active metal, for example, but not limited to, cobalt (Co), nickel (Ni), or iron (Fe).

Additional minor phases generally form either in the secondary phase or between the secondary phase and the diamond particles. These phases may include the metal carbides formed during the sintering process. These phases can form isolated islands and/or embed in the secondary phase without clear boundaries.

A process generally used for sintering the currently available cutting elements is the HPHT process, an example of which is shown in FIGS. 11 and 12. Specifically, the process includes adding diamond particles 112 and optional sintering aids 114 to a metal container 110. Then, a carbide substrate 118, generally cobalt tungsten carbide, is inserted into the metal container 110 in contact with the diamond feed 116 including optional sintering aids. The assembly 120 including the container 110, diamond feed 116 including optional sintering aids and carbide substrate 118 is subjected to the HPHT process. During the HPHT process, the binder phase originally present in the carbide substrate will be molten, turned into the liquid solvent phase, and squeezed into the diamond compact due to the high temperature 124 and pressure 122. The flow of the liquid solvent phase is also called sweep due to the fact that the liquid solvent (arrows 126 representing direction of the liquid solvent flow) will form a front face 128 while infiltrating, which carries binder and other materials from the substrate to the diamond feed.

When the diamond is submerged or surrounded by the sweeping liquid solvent phase, the diamond sintering takes place via the liquid-sintering mechanism of solution-transportation-reprecipitation. Here, the diamond-to-diamond bonding is formed and the network of diamond is built. Thus, after sintering, a superabrasive compact 100 is formed having a superabrasive layer 102 and a carbide substrate 104 bonded together at an interface 106. Based on the liquid solvent sweeping from the carbide substrate to the superabrasive layer, the portion of the carbide substrate 104*a* nearest the interface 106 and the exposed surface portion 102*a* of the superabrasive layer farthest from the interface 106 contain detrimental effects as explained below.

As mentioned above, the binder from the substrate also carries certain amounts of dissolved species from the substrate into the diamond layer. The amount of the species depends strongly upon the pressure and temperature and the composition of the substrate. Particular species that are carried with the liquid solvent phase include, for example, tungsten and carbon. The dissolved tungsten will react with binder metal and/or carbon from the diamond feed and carbide substrate. Depending on the pressure, temperature, and the composition of the liquid solvent phase, the reaction products might stay in the liquid solvent phase as solid solution species or precipitate out as carbide-based phases after cooling down to room temperature when the process is finished. This liquid solvent phase and other precipitated minor phases remain in the sintered diamond layer in between the grains and form the network of the secondary phase in the diamond layer.

The binder phase of the carbide substrate is primarily the active metal species mentioned above. However, due to use of a Co—WC substrate in the traditional HPHT process, W-C based phases will often be present in the secondary phase in the diamond layer. Many times a phase composition of W, C, and solvent metal M described by the general formula $W_xM_yC$ and commonly referred to as eta-phase, will form.

One specific eta-phase, $Co_3W_3C$, is often detected within the diamond table when enough tungsten from the carbide substrate is dissolved into the liquid solvent phase and reacts with carbon during the HPHT process. This eta-phase is known to be brittle and can be the weak link in the whole composite structure as a crack initiator. Thus, the eta-phase has detrimental effects on the mechanical properties such as abrasion resistance and toughness of the diamond table.

Eta-phase tends to appear at higher sintering temperatures and pressures, which are the conditions often used for high quality diamond compacts to enhance the diamond-to-diamond bonding. Therefore, the traditional HPHT process leads to the choice between desirable HPHT conditions for high quality diamond compact and elimination of the brittle eta-phase that tends to emerge at the desirable HPHT conditions.

In addition to eta-phase formation, the traditional HPHT process has the further disadvantage that the secondary phase for the superabrasive layer comes from the carbide substrate. This phase is not homogenously transferred from the carbide substrate to the superabrasive layer. Instead, the secondary phase comes mostly from the portion of the carbide substrate 104*a* that is nearest the interface 106. Therefore, during sintering a surface zone of the carbide substrate along the interface 106 becomes depleted of binder such that the metal content in the substrate near the interface is lower than the bulk. Less metal content in the substrate increases the hardness while decreasing the toughness. Because the interface area of the carbide is under maximal axial tensile residual stress, less tough carbide from lower metal content tends to fail easier than carbide with more metal content.

A further disadvantage of the traditional HPHT process is that by sweeping binder from the carbide to the superabrasive layer, the direction of sweep through the superabrasive layer is from the interface 106 towards the exposed surface portion 102*a*. This generally yields sintered diamond with inferior quality near the exposed cutting portion. This might be tied to sweeping in the traditional direction, where all the impurities or debris in the diamond feed might be swept to the exposed surface portion 102*a*, which is the working surface of the superabrasive compact.

Several methods have been proposed to reduce or eliminate the eta-phase in the carbide or diamond. As mentioned in U.S. Patent Application Number 2005/0061105, the binder concentration has been controlled to eliminate the eta-phase in carbide composite. Further, international patent application number WO 2008/053430 proposed a method to significantly reduce the eta-phase in the diamond composite by the addition of fine WC particulate into the feed as a dopant at fairly low mass levels prior to sintering. The XRD results confirm the reduced amount of eta-phase in the sintered compact layer. However, none of the prior art solves all of the disadvantages of a traditional HPHT sintering process.

SUMMARY

The disclosed method of production produces a superabrasive cutting element that eliminates or significantly reduces the eta-phase in the superabrasive layer to achieve optimal properties of impact and abrasion resistance. Additionally, the produced superabrasive cutting elements have an additional advantage of having no binder depletion zone in the surface of the substrate near the abrasive portion. Another advantage of the superabrasive cutting elements produced according to the disclosed method is that the sweep is in the direction from the exposed surface used for cutting into the center or back of the cutting element. Typically, the quality of sintered diamond near the sweeping source, and thus the erosion resistance, is better than that portion away from the source, possibly because impurities within the superabrasive portion are swept away from the exposed surface used for cutting.

An exemplary cutting element includes a superabrasive layer including polycrystalline diamond (PCD) and a secondary phase, and a substrate including tungsten carbide and a binder phase supporting the abrasive portion, where the superabrasive layer is substantially free of or free of eta-phase, $Co_3W_3C$.

Another exemplary cutting element includes a superabrasive layer including a superabrasive material and a secondary phase, and a substrate including a binder phase supporting the superabrasive layer. The percentage of binder phase in the surface of the substrate near the superabrasive layer is equal to or greater than the percentage of binder phase in the inner portion of the substrate.

It is to be understood that both the foregoing general description and the following detailed description are exemplary and explanatory and are intended to provide further explanation of the invention as claimed.

BRIEF DESCRIPTION OF THE DRAWINGS

The following detailed description can be read in connection with the accompanying drawings in which like numerals designate like elements and in which.

DETAILED DESCRIPTION

Definitions

Unless defined otherwise, all technical and scientific terms used herein generally have the same meaning as commonly understood by one of ordinary skill in the art to which this invention belongs.

As used herein, each of the following terms has the meaning associated with it in this section.

As used herein, "binder phase" refers to the metal or metalloid phase in the substrate.

As used herein, "secondary phase" refers to the metal or metalloid phase in the superabrasive layer after the HPHT sintering process.

As used herein, "liquid solvent phase" refers to the molten metal or metalloid phase during the HPHT sintering process either in the superabrasive layer or in the substrate.

As used herein, "source element" refers to the separate metal or metalloid that provides the molten or metalloid phase for sweeping during the HTHP process.

As used herein, "binding agent" refers to the organic species used to hold powder together during green body formation.

As used herein, "substantially free of eta-phase" refers to the eta-phase content as determined by XRD analysis wherein an XRD peak height of the <511> eta-phase peak (at a nominal d-spacing of 2.13 Å), after background correction, is 0.015 to greater than 0 when expressed as a fraction of the peak height of the <200> cubic cobalt peak ($I_{eta}$:$I_{Co}$).

As used herein, "free of eta-phase" refers to the eta-phase content as determined by XRD analysis wherein an XRD peak height of the <511> eta-phase peak (at a nominal d-spacing of 2.13 Å), after background correction, is 0 when expressed as a fraction of the peak height of the <200> cubic cobalt peak ($I_{eta}$:$I_{Co}$).

As used herein, "substantially no binder phase" refers to an amount of binder phase of less than about 6 wt % to greater than 0 wt %.

As used herein, "no binder phase" refers to an amount of binder phase of 0 wt %.

Description

Figure 1:
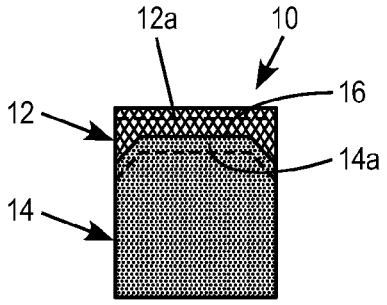
FIG. 1 shows a cutting element according to an embodiment of the invention.

Disclosed is an improved cutting element, including, for example, a superabrasive cutting element used in drag bits, formed according to embodiments of the method described below. The improved cutting element contains, among other improvements, better cutter life. Similar to traditional cutters, a cutting element 10 according to a particular embodiment also contains a superabrasive layer 12 and substrate 14 containing a secondary phase and binder phase, respectively, and bonded at an interface 16 as illustrated in FIG. 1. However, unlike traditional cutters, the cutting element 10 includes improved structure on the micro level both in the substrate 14 near the interface 16 and in the superabrasive layer 12.

In particular, the cutting element 10 is sintered according to a HPHT process that results in the superabrasive layer being substantially free of or free of eta-phase, $Co_3W_3C$, as determined by XRD analysis. The superabrasive layer is substantially free or free of eta-phase even where the superabrasive layer 12 comprises polycrystalline diamond and the substrate 14 comprises cobalt tungsten carbide. Further, the substrate 14 includes an interface surface portion 14*a*, which is the surface zone of the substrate 14 nearest the interface 16. The surface portion 14*a* of the substrate contains a percentage of binder equal to or greater than the percentage of binder in the inner portion of the substrate 14. Further, the superabrasive layer 12 includes an exposed surface portion 12*a*, which is the surface of the superabrasive layer 12 furthest from the interface 16. The exposed surface portion 12*a* is the working area of the cutting element 10, especially when the cutting element is a superabrasive cutter for a drag bit. The exposed surface portion 12*a* of the superabrasive layer 12 is of better quality and has better erosion resistance. For example, the exposed surface portion 12*a* may contain fewer impurities than the surface of the superabrasive layer nearest the interface 16.

The above micro level structural differences, as well as others presented below can be better understood from the description of embodiments of the method of making the exemplary cutting element 10. According to embodiments of the method of making the cutting element, the source for the secondary phase present in the superabrasive layer and the binder phase in the substrate of the finished cutting element is introduced from pure active catalytic metal, metal alloy, or metalloid elements placed in a reaction container separate from either the superabrasive layer or the substrate.

Figure 2:
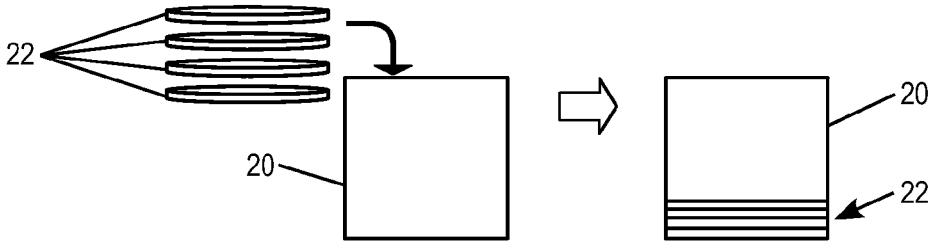
FIG. 2 is a pictorial representation of an exemplary first preliminary step for producing the cutting element of FIG. 1.

A particular embodiment for making the cutting element 10 is illustrated in FIGS. 2-6 as a five step process. The exemplary process includes forming a source element 22 as a stand alone pure catalytic metal, metal alloy, or metalloid element. Once formed, the source element 22 is placed into a reaction container 20 as illustrated in FIG. 2. The reaction container may comprise molybdenum, niobium, tantalum, vanadium, zirconium, hafnium, or tungsten, or combinations thereof. In some embodiments, the reaction container has a double cup design. A double cup design has improved ability to maintain its integrity by better holding its shape and better avoiding deleterious reactions between the reactor elements and the materials used to form the cutting elements. In further embodiments, the metal container has a thick wall with a thickness, for example, from about 0.002 to about 0.020 inches, in order to more effectively withstand metal erosion and/or resist cracking.

In certain embodiments, the source element 22 has a uniform thickness across the entire cross-sectional area of the reaction container 20. In particular, where the reaction container is cylindrical, the source element 22 is formed into thin disks. Disk shaped in order to uniformly cover the entire cross-sectional area of the cylindrical reaction container, and thin so that the high pressure and high temperature conditions during sintering can uniformly melt the source element 22 for infiltration into the superabrasive layer and substrate. However, other shapes or forms, including, for example, powders that flow and thus fill the entire cross-sectional area of the reaction container can be used. Further, thicker source elements may be used depending on the desired melting and sweeping during the HPHT process.

In further embodiments, more than one source element 22 may be placed in the reaction container. For example, FIG. 2 illustrates placing four source elements 22 in the reaction container. Where multiple source elements 22 are used, each of the elements may be formed of the same material or different materials. Specifically, source elements formed of different materials can include use of different metalloids, different catalytic metals, different percentages of catalytic metals in alloys, combinations of metals and metalloids, or binder elements having the same catalytic metal or metalloid, but with different additives. Where different materials are used as source elements in the same reaction container, multiple sweep can be achieved. Multiple sweep is where different source elements sweep through the superabrasive layer to the substrate at different times during the HPHT process. This occurs by placing source elements 22 of different materials into the container in a manner such that the source elements 22 melt at different stages, and thus sweep at different stages. In particular, the source elements 22 can be arranged in order of their melting temperatures, with the lowest melting temperature source element nearest the superabrasive layer.

The source element 22 may be any known in the art as a binder for superabrasive materials such as polycrystalline diamond or cubic boron nitride and for a substrate for the superabrasive materials such as carbides. Exemplary source elements include metals such as cobalt, nickel, iron, or an alloy containing one or more of these metals as well as metalloids such as silicon. In certain embodiments, the source element includes cobalt. The source elements may further include any known additives used in the binder phase of carbides and/or superabrasive materials. Additives can include transition metals selected from groups IVB to VIIIB, for example, chromium, molybdenum, manganese, vanadium, titanium, zirconium, hafnium, niobium, or tantalum or combinations thereof. Very little or no tungsten is added to the source element 22 to prevent formation of eta-phase within the superabrasive layer.

The number or size of the source elements 22 placed in the reaction container should be included in an amount equal to or greater than a total amount of the desired secondary phase in the superabrasive layer and the desired binder phase in the substrate layer after HPHT. Typically, this binder is present in an amount of about 10 wt % to about 20 wt %, about 10 wt % to about 15 wt %, or about 11 wt % to about 14 wt % in the substrate body, but may be as low as about 3 to about 6 wt %. The amount of material in the source element should be enough to satisfy the secondary phase and binder phase requirements of the superabrasive layer and the substrate. Any excessive material from the source elements will remain in the reaction container.

In further embodiments, the source elements 22 may be placed in other locations besides the bottom of the reaction container adjacent the superabrasive layer. For example, in some embodiments, additional source elements 22 may be placed on the surface of the substrate opposite the interface 16. In this manner, the liquid solvent phase may sweep to the substrate 14 both indirectly through the superabrasive layer and directly from the opposite direction, such that both sweeps would end in the central portion of the substrate 14. Placing additional source elements 22 on the surface of the substrate opposite the interface 16 has a number of potential advantages. Such placement can provide a more balanced distribution of the source elements. This can be advantageous because, during sintering, the source elements will infiltrate into the superabrasive layer and substrate leaving a potential void between the initial location of the superabrasive layer and the bottom of the reaction container. This void could lead to warping or cracking of the reaction container under the high pressure conditions. With source elements on either side of the assembly, the void on either side is less such that potential warping or cracking of the reaction container is reduced. Additionally, tungsten can be added to the source elements that are placed on the surface of the substrate opposite the interface 16. This enables the substrate to gain the benefits of tungsten in the binder phase, while preventing tungsten from infiltrating the superabrasive layer, where it can form eta-phase.

Figure 3:
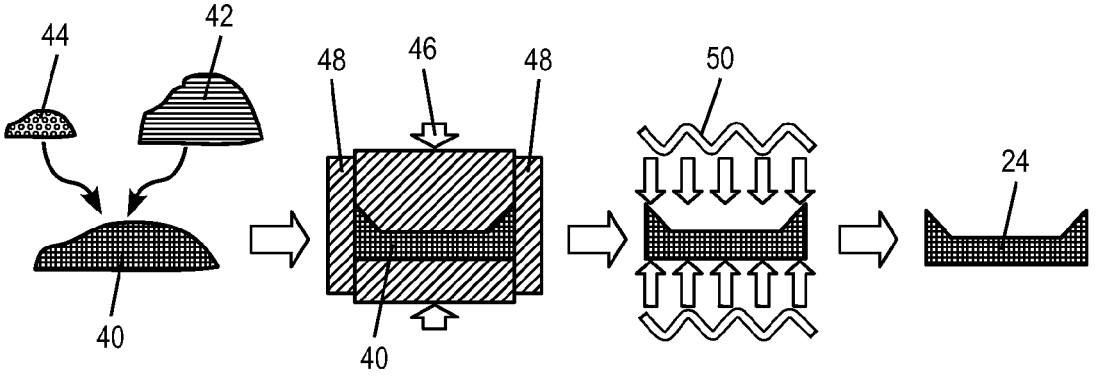
FIG. 3 is a pictorial representation of an exemplary second preliminary step for producing the cutting element of FIG. 1.

According to embodiments of the method of making the cutting element, the superabrasive material may be pre-sintered into a green body 24 before placing it in the reaction container 20. Pre-sintering a green body 24 of superabrasive material prior to the HPHT sintering process may be conducted. FIG. 3 illustrates a particular embodiment for forming a pre-sintered green body of superabrasive material to be placed in the reaction container. First, a superabrasive feed 40 is formed. Because superabrasive particles tend not to adhere to one another during pressing, the superabrasive feed 40 is formed by mixing superabrasive particles 42 with a binding agent 44 that can be burned off during pre-sintering. Exemplary binding agents include polymer/organic binders, including, for example, polyethylene glycol (PEG), polyvinyl butyral (PVB), or polyvinyl acetate (PVA), ethyl cellulose, or combinations thereof. Other additives may also be added to the superabrasive feed 40 to improve certain properties of the superabrasive layer, such as, for example, tungsten or cobalt or combinations thereof.

Exemplary superabrasive particles 42 include polycrystalline diamond (PCD) and/or cubic boron nitride (CBN). Eta-phase is of particular concern when using polycrystalline diamond as the superabrasive particles, because the carbon of diamond can combine with tungsten and solvent metal to form the eta-phase. Diamond particles may be natural or synthetic in origin. The average grain size of the superabrasive particles can be in the range between submicron and about 100 microns in size. In particular embodiments, the grain size is from about 5 to about 40 microns.

After mixing, the superabrasive feed 40 is placed in a die 48 and is pressed using pressure 46 into the desired shape. After pressing, heat 50 is applied through pre-sintering to burn off the binding agent or decompose the binding agent into graphite and/or amorphous carbon. At this stage the green body 24 is created and can hold its shape as shown in FIG. 3. In certain embodiments, die pressing is performed at a pressure from about 100 Mpa to about 800 Mpa, about 300 Mpa to about 600 Mpa, or about 700 Mpa to about 1 Gpa. In more certain embodiments, pre-sintering is performed at a temperature sufficient to burn off or decompose the binding agent into graphite and/or amorphous carbon. For example, the temperature may be from about −200 to about 1000° C.

Figure 4:
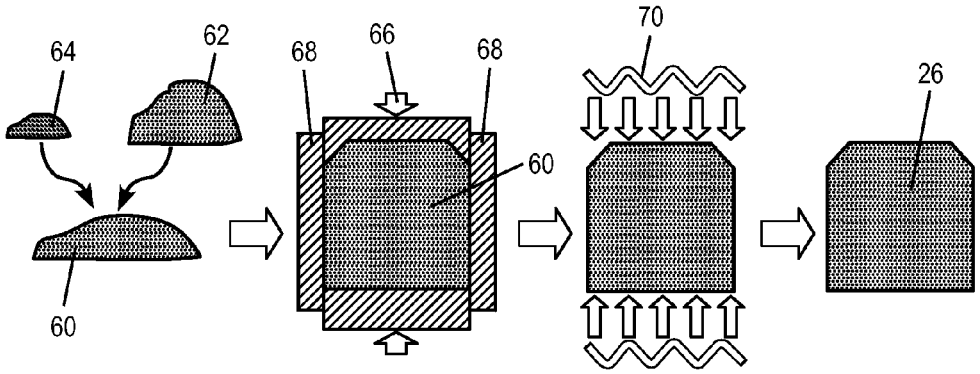
FIG. 4 is a pictorial representation of an exemplary third preliminary step for producing the cutting element of FIG. 1.

Further, according to embodiments of the method for making the exemplary cutting elements, the substrate 14 is preformed into a green body substrate 26 prior to placing in the reaction container 20. FIG. 4 illustrates a particular embodiment for forming a green body substrate 26 for placing in the reaction container 20 prior to HPHT sintering. A substrate feed 60 is formed from a powder 62 of substrate material. In certain embodiments, the substrate material includes a carbide. Exemplary carbides include tungsten carbide, titanium carbide, or tantalum carbide, or combinations thereof. A particular carbide for use as a substrate is tungsten carbide. The substrate may further include minor percentages of cubic carbides, for example, niobium carbide, vanadium carbide, hafnium carbide, chromium carbide, manganese carbide, molybdenum carbide, and zirconium carbide. Because substantially no binder phase (less than about 6 wt % to greater than 0 wt %, less than about 3 wt % to greater than 0 wt %, or less than about 2 wt % to greater than 0 wt %) in the substrate infiltrates the superabrasive layer, the substrate can be formed with cubic carbides that will not be present in the superabrasive layer. In an embodiment, there may be no binder phase (0 wt %) in the substrate.

The substrate feed 60 is placed in a die 68 and is pressed using pressure 66 into the desired shape. At this stage the substrate 26 is created and can hold its shape as shown in FIG. 4. In certain embodiments, die pressing is performed at a pressure from about 100 Mpa to about 800 Mpa, about 300 Mpa to about 600 Mpa, or about 700 Mpa to about 1 Gpa.

In further embodiments, the powder 62 of substrate material is mixed with a substrate binding agent 64 that can be burned off during pre-sintering to form the substrate feed 60. Although when powder 62 is a carbide the internal friction is high enough such that a substrate binding agent is not required to form a green body that holds its own shape, a substrate binding agent 64 can be added to improve the integrity of the green body. Exemplary substrate binding agents include polymer/organic binders, including, for example, polyethylene glycol (PEG), polyvinyl butyral (PVB), or polyvinyl acetate (PVA), ethyl cellulose, or combinations thereof. Other additives may also be added to the substrate feed 60 to improve certain properties of the substrate, such as, for example, V, Mb, Cr, Ni, Fe, Co. Because substantially no binder phase or no binder phase in the substrate infiltrates the superabrasive layer, additives provided in the substrate, including metals, do not migrate to the superabrasive layer. Therefore, in some embodiments, the substrate contains metals or other additives that will not be present in the superabrasive layer.

Where a substrate binding agent is added to the substrate in formation of the green body substrate, a pre-firing step is performed. In certain embodiments, after pressing, heat 70 is applied at temperatures sufficient to burn off the substrate binding agent or decompose the binding agent into graphite and/or amorphous carbon through pre-sintering. For example, the temperature may range from about 200° C. to about 1400° C., about 400° C. to about 1000° C., or about 450° C. to about 800° C.

In particular embodiments, the green body substrate 26 contains substantially no binder phase, at least after a pre-sintering step. To prevent binder phase from the substrate infiltrating the superabrasive layer, substantially no binder phase is introduced into the green body substrate 26 prior to sintering. By eliminating any possible infiltration of binder phase from the substrate into the superabrasive layer, the superabrasive layer is substantially free of or free of etaphase, and the binder phase content of the interface surface portion 14*a* of the substrate is the same or greater than the binder phase content of other portions of the substrate 14.

Figure 5:
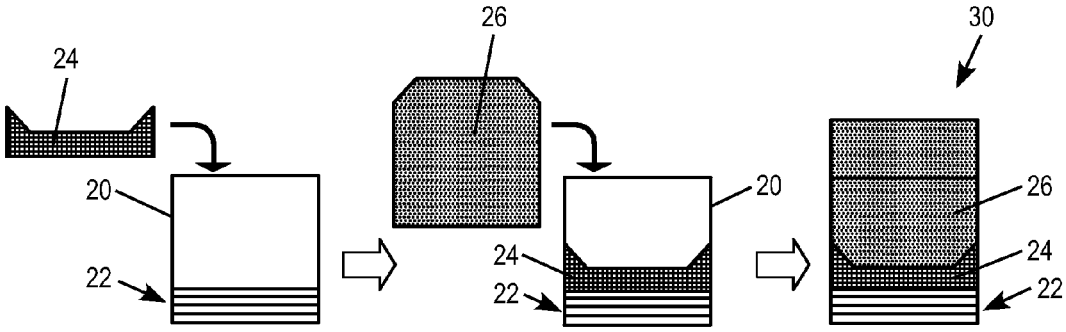
FIG. 5 is a pictorial representation of an exemplary assembly step for producing the cutting element of FIG. 1.

After formation of the superabrasive green body 24 and green body substrate 26, the assembly 30 to be sintered by HPHT process into a cutting element according to one of the embodiments is prepared, as illustrated in FIG. 5. The superabrasive green body 24 is placed into the reaction container 20 adjacent to the source elements 22. Further, a green body substrate 26 is placed adjacent to the superabrasive green body 24. The superabrasive green body 24 and green body substrate 26 are arranged such that corresponding surfaces are in contact. Particular interface patterns can be designed between the superabrasive green body 24 and green body substrate 26 to relieve the residual stress after HPHT process. An example of such an interface pattern is illustrated in FIG. 5.

In further embodiments, an intermediate layer may be formed between the superabrasive green body 24 and the green body substrate 26. The intermediate layer is particularly used in embodiments in which the superabrasive green body includes polycrystalline diamond, the green body substrate includes tungsten carbide, and the binder element is cobalt. In such embodiments, tungsten carbide powder is added to the superabrasive green body as a bottom layer adjacent to the carbide for stress management. The layered structure provides a compositional gradient from the green body substrate to the superabrasive green body surface. By sintering according to the disclosed embodiments, such a multi-layered cutting element has both a top high-quality diamond layer free of tungsten-based eta-phase, and a bottom transitional layer of tungsten carbide powder.

Figure 6:
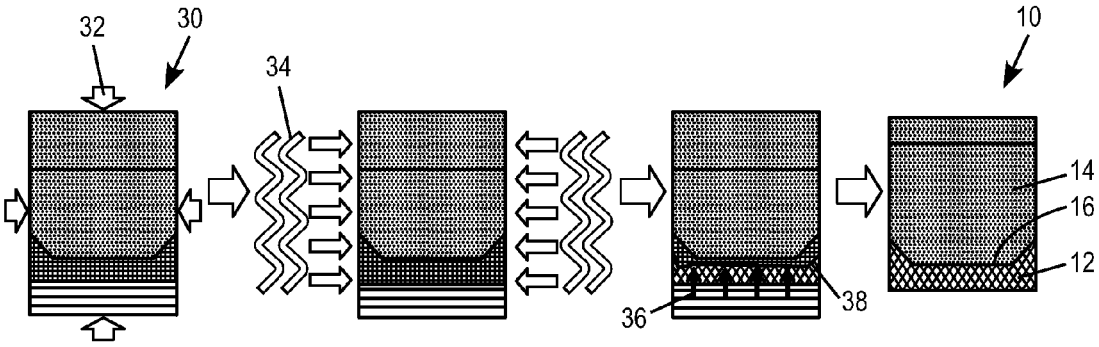
FIG. 6 is a pictorial representation of an exemplary sintering step for producing the cutting element of FIG. 1.

In yet further embodiments, once the assembly is prepared, the whole assembly 30 is placed into a reactor (not shown) and is subjected to the HPHT process, as illustrated in FIG. 6. During the HPHT process in which high pressure 32 and high temperature 34 are applied to the assembly 30, the source elements 22 melt and infiltrate or sweep through the superabrasive green body 24 first. In certain embodiments, the flow of the source elements 22 is also called sweep due to the fact that liquid solvent phase (arrows 36 representing direction of liquid solvent phase flow) will form a front face 38 while infiltrating, which carries material from the source elements and other materials such as impurities from the exposed surface portion of the green body towards the substrate. As the material from the source elements 22 sweeps through the superabrasive green body 24 it is sintered. Then, the sweep continues into the green body substrate 26 to sinter the substrate material and to form an integral bond between the superabrasive layer 12 and the substrate 14 at the interface 16. In particular embodiments, the HPHT sintering process subjects the assembly 30 to pressures of from about 50 to about 100 kilobars and temperatures of from about 1300° C. to about 1800° C. In yet more particular embodiments, the pressure is from about 60 to about 80 kilobars and the temperature is from about 1400 to about 1700° C.

Figure 7:
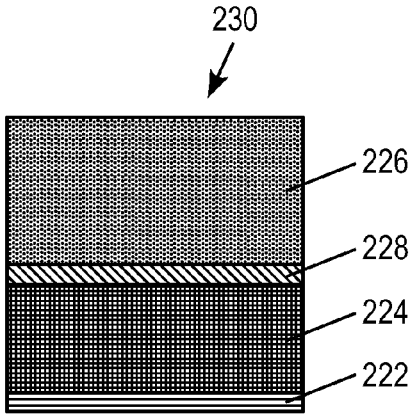
FIG. 7 shows a first alternative intermediate assembly to be formed in an assembly step similar to FIG. 5.

FIG. 7 illustrates a second embodiment of the intermediate assembly to be sintered by the HPHT process exemplified in FIG. 6. Specifically, FIG. 7 illustrates an assembly 230 that is similar to assembly 30 in FIG. 5, but also includes a barrier layer 228. The barrier layer 228 placed between a substrate 226 made according to conventional substrate formation methods, including, for example, sintering the substrate prior to assembly, and a superabrasive green body 224 made according to methods described with regard to formation of superabrasive green body 24 in FIG. 3. In FIG. 7, the barrier layer 228 provides a barrier against binder phase from the substrate 226 from sweeping into the superabrasive green body 224 during the HPHT sintering process. The barrier layer 228 also acts as a barrier layer preventing or hindering a source element 222, which is similar to the source element 22 described in relation to FIG. 2, from sweeping into the substrate 226. Therefore, in accordance with this embodiment binder phase is added directly to the substrate 226 prior to the assembly and HPHT sintering steps.

In accordance with this embodiment, eta-phase formation in the superabrasive layer is prevented or reduced even where binder phase in the substrate is added to the substrate prior to the assembly and HPHT sintering steps. In general, eta-phase formation will not occur, or only in small quantities, under these conditions, at least because the substrate binder phase, under HPHT conditions, will be prevented by or at least inhibited by the barrier layer 228 from sweeping tungsten (or dissolved tungsten element) into the superabrasive green body 224.

Figure 8:
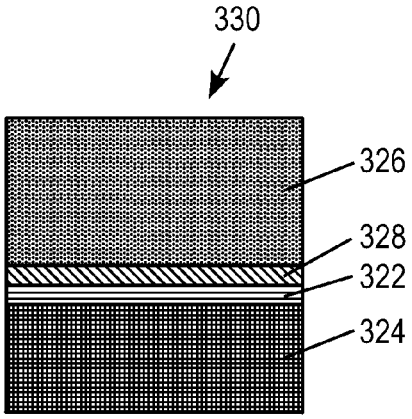
FIG. 8 shows a second alternative intermediate assembly to be formed in an assembly step similar to FIG. 5.

FIG. 8 illustrates a third embodiment of the intermediate assembly to be sintered by a HPHT process similar to the process exemplified in FIG. 6. Specifically, FIG. 8 illustrates an assembly 330 that is similar to assembly 230 in that the assembly 330 includes a barrier layer 328 between the substrate 326 and the superabrasive green body 324. Also, similar to the embodiment of FIG. 7, the substrate 326, superabrasive green body 324, and the source element 322, can be any substrate, superabrasive, or source element referred to with regard to the embodiment of FIGS. 2-5.

In contrast to the embodiment of FIG. 7, the binder element 322 is placed between the barrier layer 328 and the superabrasive green body 324. In this embodiment, the HPHT sintering process will result in sweep of the binder element 322 in liquid state into the superabrasive green body 324 in the direction opposite to the sweep described with regard to the assembly 30 or 230 of FIG. 5 or 7, respectively.

Exemplary materials used to form the barrier layer 228, 328 in FIGS. 7 and 8 include TiN, TaN, ZrN, HfN, TiC, TaC, ZrC, or HfC. The barrier layer 228, 328 will have a thickness sufficient to reduce or prevent binder phase or material in the substrate from sweeping through the barrier layer. For example, the thickness of the barrier layer 228, 328 is from about 3 to about 20 micrometers. In certain embodiments, the thickness is from about 5 to about 20 micrometers.

Figure 9:
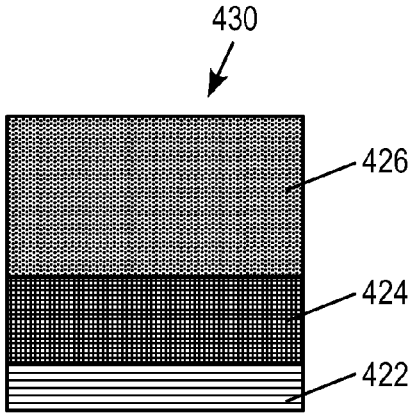
FIG. 9 shows a third alternative intermediate assembly to be formed in an assembly step similar to FIG. 5.
Figure 10:
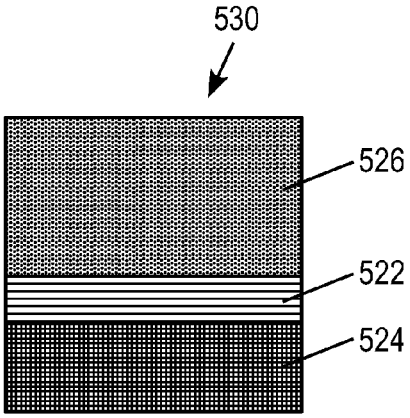
FIG. 10 shows a fourth alternative intermediate assembly to be formed in an assembly step similar to FIG. 5.
Figure 11:
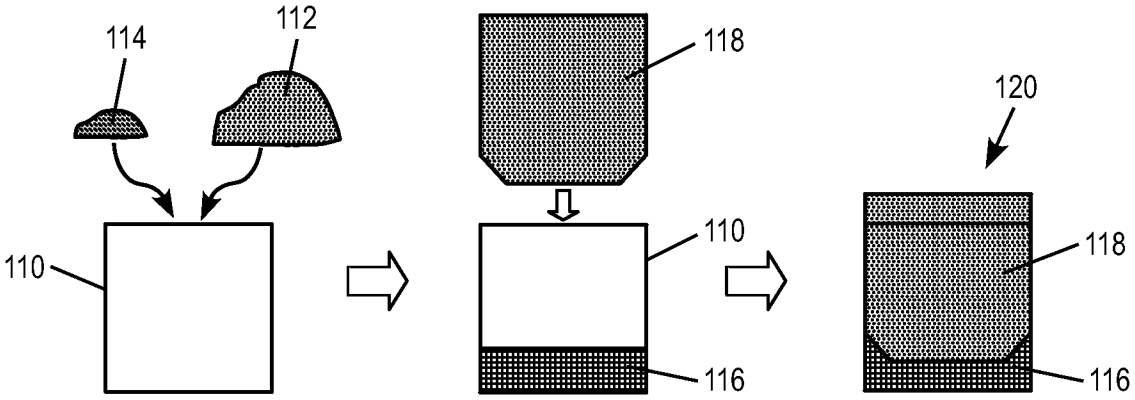
FIG. 11 is a pictorial representation of an assembly step for producing prior art cutters.
Figure 12:
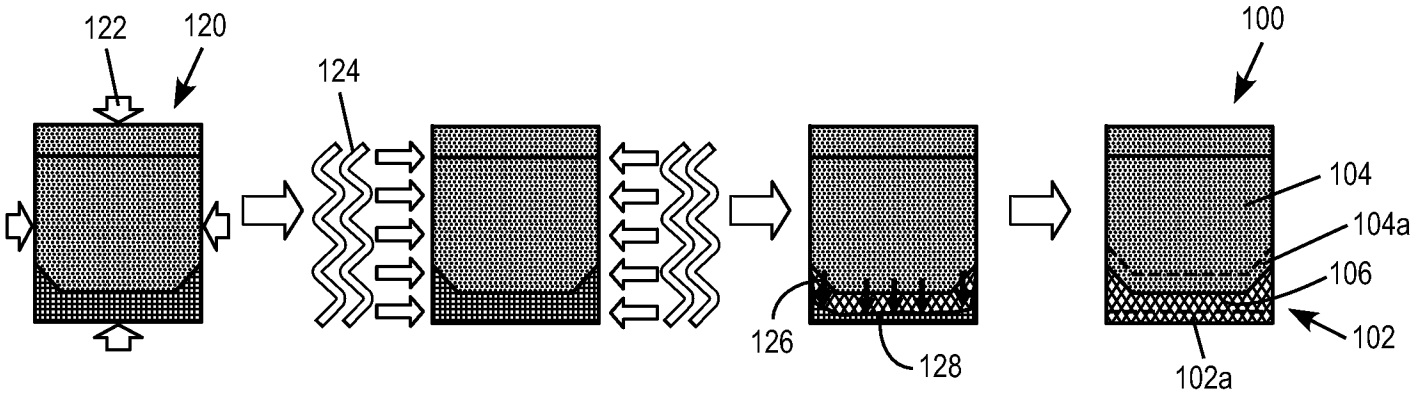
FIG. 12 is a pictorial representation of a sintering step for producing prior art cutters.

FIGS. 9 and 10 illustrate fourth and fifth embodiments of the intermediate assembly to be sintered by a HPHT process that is modified in relation to the process exemplified in FIG. 6. In particular, the assemblies of FIGS. 9 and 10 will be subjected to a controlled HPHT profile, where the assemblies are subject to at least two different pressure/temperature conditions during the HPHT sintering step. First, the first temperature and pressure is set above the melting temperature of source elements 422, 522, but below the melting temperature of the binder phase or material added to the substrate 426, 526.

In accordance with these embodiments, a binder phase or material can be formed or added to the substrate 426,526 prior to the assembly and HPHT sintering steps, but still reduce or prevent eta-phase formation that may be caused by sweeping tungsten from the substrate into the superabrasive green body 424, 524 with the binder phase or material during HPHT sintering.

During the lower temperature condition of the controlled HPHT profile, the source element 422, 522 melts and sweeps into the superabrasive green body 424, 524, and possibly also the substrate 426, 526. Then, after the superabrasive layer is already sintered, the temperature and pressure is increased to melt the binder phase or material in the substrate 426, 526 to bond the superabrasive layer to the substrate. At least because the superabrasive layer is sintered prior to melting the binder material in the substrate 426, 526, the molten binder phase or material from the green body substrate 426, 526 will not sweep any or a reduced amount of tungsten into the superabrasive layer, thus resulting in a reduced amount or no eta-phase formation wherein the superabrasive layer is substantially free of or free of eta-phase.

FIG. 9 illustrates an assembly 430 to be used in a reverse sweep sintering step in which the source element 422 is placed below the superabrasive green body 424, such that the liquid solvent phase formed by melting the source element 422 sweeps upward into the superabrasive green body prior to reaching the substrate 426. FIG. 10 illustrates an assembly 530 to be used in a regular sweep sintering step in which the source element 522 is placed between the superabrasive green body 524 and the substrate 526, such that the liquid solvent phase formed by melting the source element 522 sweeps downward into the superabrasive green body, and possibly also upwards into the substrate 526.

The source element 422, 522 can be any catalytic metal having a lower melting temperature than a binder phase or material incorporated in the substrate 426, 526 prior to the HPHT sintering step. In certain embodiments, the binder phase or material incorporated in the substrate 426, 526 prior to the HPHT sintering step is cobalt, nickel, iron or an alloy containing one or more these metals as well as metalloids such as silicon. In yet more certain embodiments, the source element 422, 522 may include cobalt, nickel, iron or an alloy containing one or more of these metals as well as metalloids such as silicon, all of which having a melting temperature lower than the binder phase or material incorporated in the substrate 426, 526. In particular embodiments, the binder phase or material incorporated in the substrate 426, 526 prior to the HPHT sintering step is cobalt or a cobalt based alloy, and the source element 422, 522 is cobalt or a cobalt based alloy having a melting temperature less than that of the binder phase or material incorporated in the substrate.

In certain embodiments, the difference between the melting temperatures of the source elements and the binder phase or material incorporated in the substrate is 20° C. or higher. In more certain embodiments, the difference in melting temperatures is 45° C. or higher. In yet more certain embodiments, the difference in melting temperatures is 100° C. or higher, or 200° C. or higher, or even 400° C. or higher. In specific embodiments, the source elements 422, 522 could be a combination of Co—Fe alloy/Co having a melting point difference of about 45° C. or a combination of B—Co alloy/Co having a melting point difference of about 400° C. Also, the substrate 426, 526 and superabrasive green body 424, 524 can be any substrate or superabrasive layer, referred to with regard to the embodiment of FIGS. 3-5.

With regards to the embodiments of FIGS. 7-10, the number or size of the source elements 222, 322, 422, 522 placed in the reaction container should be included in an amount equal to or greater than an amount of secondary phase in the superabrasive layer after HPHT process.

Cutting elements 10 produced by embodiments of the method disclosed above contain superabrasive layers 12 that are substantially free of or free of eta-phase, as determined by XRD analysis. In a particular embodiment, the XRD peak height of the <511> eta-phase peak (at a nominal d-spacing of 2.13 Å), after background correction, is 0.015 or less when expressed as a fraction of the peak height of the <200> cubic cobalt peak ($I_{eta}$:$I_{Co}$). In a more particular embodiment, the XRD peaks expressed as a fraction is 0.010 or less. In a yet more particular embodiment, the XRD peaks expressed as a fraction is 0.0005 or less. In certain embodiments, the superabrasive layer contains no eta-phase, i.e., free of eta-phase, with a fraction of XRD peak of 0.

Further, embodiments of the cutting elements produced by the method disclosed above have better sintered diamond quality in the exposed surface portion 12*a* of the superabrasive layer, and thus better erosion resistance. It is believed this is due to the fact that the infiltration or sweeping of the liquid solvent phase effectively pushes the impurities from the exposed surface portion of the superabrasive layer to the interface portion of the superabrasive layer and/or into the substrate. Superabrasive material quality generally degrades from the sweep source to the far-away end. By sweeping from the exposed surface portion of the superabrasive layer to the substrate, it is believed that the highest quality portion of the superabrasive layer will be the exposed surface portion, which acts as the working area of the cutting element.

Figure 13:
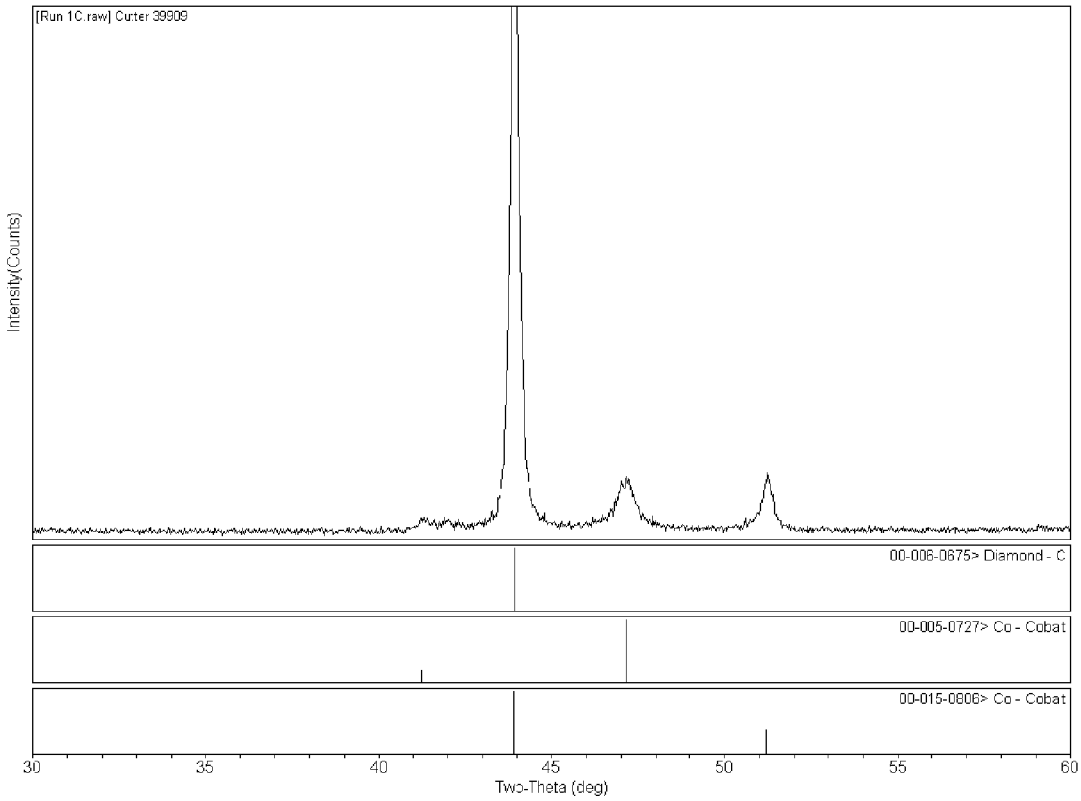
FIG. 13 is an x-ray diffraction (XRD) analysis of a cutter of an embodiment of the invention.

FIG. 13 shows an analysis of a cutting element that is free of eta-phase, as determined by XRD analysis. This cutting element is made with similar method as described in FIG. 5 and FIG. 6. One Co—Fe alloy disk is put into a Ta container. Diamond feed is loaded into the container and a sintered Co—WC substrate is put into the container successively. The cutter is subjected to pressure of about 60 to about 75 kilobars and temperature of about 1400 to about 1600° C. The Co disk was melted and swept through the diamond layer. No tungsten species including WC and eta-phase from the substrate was detected by the XRD analysis from the top surface of the diamond layer. This result was confirmed by X-ray fluorescent spectrum (XRF) data as shown in Table 1. No tungsten element or species were detected from the top surface of the diamond layer.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A cutting element, comprising:

a superabrasive layer comprising polycrystalline diamond (PCD) and a secondary phase, and a substrate comprising tungsten carbide and a binder phase supporting the superabrasive layer, wherein the superabrasive layer has eta-phase, $Co_3W_3C$, as determined by XRD analysis wherein an XRD peak height of the <511> eta-phase peak (at a nominal d-spacing of 2.13 Å), after background correction, which peak height is 0.015 or less than 0.015 but greater than 0 when expressed as a fraction of the peak height of the <200> cubic cobalt peak ($I_{eta}$:$I_{Co}$).

2. The cutting element of claim 1, wherein the percentage of binder phase in the surface portion of the substrate near the abrasive portion is equal to or greater than the percentage of binder phase in the inner portion of the substrate.

3. The cutting element of claim 1, wherein the substrate contains elements that are not present in the superabrasive layer.

4. The cutting element of claim 1, wherein the cutting element further comprises a barrier layer between the superabrasive layer and the substrate.

5. The cutting element of claim 1, wherein the secondary phase in the superabrasive layer is not the same as the binder phase in the substrate.

6. The cutting element of claim 1, wherein the secondary phase in the superabrasive layer and the binder phase in the substrate are the same.

7. The cutting element of claim 1, wherein the secondary phase or the binder phase comprises Si, Co, Fe, Cr, Mo or Ni, or alloys or combinations thereof.

8. The cutting element of claim 7, wherein the secondary phase or the binder phase comprises Co.

9. The cutting element of claim 1, wherein the superabrasive layer is substantially free of eta-phase content as determined by XRD analysis, wherein an XRD peak height of the <511> eta-phase peak, after background correction, is 0.015 to greater than 0 when expressed as a fraction of the peak height of the <200> cubic cobalt peak.

10. The cutting element of claim 9, wherein the XRD peaks expressed as a fraction is 0.005 or less.

11. The cutting element of claim 1, wherein the superabrasive layer contains no eta-phase.

12. The cutting element of claim 1, wherein the substrate contains cubic carbides selected from the group consisting of TiC, TaC, NbC, VC, HfC, $Cr_2O_3$, ZrC, MnC, MoC, and combinations thereof.

13. The cutting element of claim 12, wherein the superabrasive layer does not contain at least one of the cubic carbides present in the substrate.

14. The cutting element of claim 1, wherein the superabrasive layer has better erosion resistance along an exposed portion of the superabrasive layer opposite the interface than the substrate.

15. The cutting element of claim 1, wherein the superabrasive layer is free of eta-phase content as determined by XRD analysis wherein an XRD peak height of the <511> eta-phase peak (at a nominal d-spacing of 2.13 Å), after background correction, is 0 when expressed as a fraction of the peak height of the <200> cubic cobalt peak.

16. A cutting element comprising: a superabrasive layer comprising a superabrasive material and a secondary phase, and a substrate including a binder phase supporting the superabrasive layer, wherein the percentage of binder phase in the surface portion of the substrate near the superabrasive layer is equal to or greater than the percentage of binder phase in the inner portion of the substrate; wherein the superabrasive layer has is substantially free of etaphase, $Co_3W_3C$, as determined by XRD analysis wherein an XRD peak height of the <511> eta-phase peak (at a nominal d-spacing of 2.13 Å), after background correction, which peak height is 0.015 or less than 0.015 but greater than 0 when expressed as a fraction of the peak height of the <200> cubic cobalt peak ($I_{eta}$:$I_{co}$).

17. The cutting element of claim 16, wherein the superabrasive material comprises polycrystalline diamond (PCD) or cubic boron nitride (CBN).

18. The cutting element of claim 17, wherein the superabrasive material comprises PCD.

19. The cutting element of claim 16, wherein the carbide comprises tungsten carbide, titanium carbide, or tantalum carbide or combinations thereof.

20. The cutting element of claim 19, wherein the carbide comprises tungsten carbide.

21. The cutting element of claim 16, wherein the substrate contains elements that are not present in the superabrasive layer of the cutting element.

22. The cutting element of claim 16, wherein the superabrasive layer has better erosion resistance along an exposed portion of the superabrasive layer opposite the interface than the substrate.

23. A cutting element, comprising:

a superabrasive layer comprising polycrystalline diamond (PCD) and a secondary phase, and a substrate comprising tungsten carbide and a binder phase supporting the superabrasive layer, wherein the superabrasive layer is free of eta-phase, $Co_3W_3C$.

24. A method for making a cutting element free of eta-phase content comprising the steps of:

pre-sintering a superabrasive material into a green body;

placing the green body into a reaction container; subjecting said reaction container containing the green body to a high pressure, high temperature process; and removing said cutting element, wherein the superabrasive layer is substantially free of eta-phase, $Co_3W_3C$.

* * * * *